US008827246B2

(12) United States Patent
Swasey et al.

(10) Patent No.: US 8,827,246 B2
(45) Date of Patent: Sep. 9, 2014

(54) SCISSOR LIFT

(75) Inventors: Merin Swasey, North Logan, UT (US); Tyler R. Kirby, Logan, UT (US)

(73) Assignee: Parking Source LLC, Miami, FL (US)

( * ) Notice: Subject to any disclaimer, the term of this patent is extended or adjusted under 35 U.S.C. 154(b) by 221 days.

(21) Appl. No.: 13/429,392

(22) Filed: Mar. 25, 2012

(65) Prior Publication Data

US 2012/0241698 A1 Sep. 27, 2012

Related U.S. Application Data

(60) Provisional application No. 61/467,947, filed on Mar. 25, 2011.

(51) Int. Cl.
*B66F 7/06* (2006.01)

(52) U.S. Cl.
USPC ..... 254/122; 254/126; 254/89 R; 254/92; 254/322

(58) Field of Classification Search
CPC ..... B66F 7/0608; B66F 7/065
USPC ..... 254/122, 126, 892, 92, 322, 328, 9 C
See application file for complete search history.

(56) References Cited

U.S. PATENT DOCUMENTS

| | | | | |
|---|---|---|---|---|
| 1,545,223 | A * | 7/1925 | Westrate | 254/126 |
| 1,991,255 | A | 2/1935 | Martin | |
| 3,901,356 | A * | 8/1975 | Butler | 187/211 |
| 4,086,828 | A * | 5/1978 | Mader | 81/485 |
| 4,534,544 | A * | 8/1985 | Heide | 254/9 C |
| 4,899,987 | A * | 2/1990 | Craig | 254/122 |
| 5,206,996 | A * | 5/1993 | McDaniel | 30/101 |
| 5,615,575 | A * | 4/1997 | Goodwin | 73/862.541 |
| 5,694,864 | A * | 12/1997 | Langewellpott | 108/145 |
| 6,286,629 | B1 * | 9/2001 | Saunders | 187/394 |
| 6,305,668 | B1 * | 10/2001 | Edens | 254/93 R |
| 6,523,432 | B1 * | 2/2003 | Yamamoto et al. | 74/492 |
| 6,705,238 | B1 | 3/2004 | Heckert | |
| 6,742,768 | B2 * | 6/2004 | Alba | 254/122 |
| 6,814,188 | B1 * | 11/2004 | Heckert | 187/269 |
| 6,854,715 | B2 * | 2/2005 | Hicks et al. | 254/122 |
| 7,213,686 | B2 * | 5/2007 | Kaufman | 187/262 |

(Continued)

FOREIGN PATENT DOCUMENTS

| | | | |
|---|---|---|---|
| EP | 1342429 | A1 | 9/2003 |
| FR | 1383677 | * | 11/1964 |

OTHER PUBLICATIONS

International Search Report for corresponding PCT Application No. PCT/US2012/030492, mailed Oct. 31, 2012.

*Primary Examiner* — George Nguyen
(74) *Attorney, Agent, or Firm* — Myers Wolin, LLC

(57) ABSTRACT

A scissor lift comprises a load support, a lift support and at least one scissor assembly defined between the load support and the lift support, the at least one scissor assembly being driven into an open or a closed position by a drive device that enables movement of the load support relative to the lift support with the opening and closing of the at least one scissor assembly, wherein the at least one scissor assembly is further defined by a pair of arms attached at a pivot, and where the pair of arms further comprises a curved outer surface that engages a portion of a drive device for urging the scissor arms apart and for moving the load support relative to the lift support.

22 Claims, 9 Drawing Sheets

(56) References Cited

U.S. PATENT DOCUMENTS

| | | | | |
|---|---|---|---|---|
| 7,905,198 | B2 * | 3/2011 | Moon | 118/500 |
| 7,950,628 | B2 * | 5/2011 | Warren et al. | 254/122 |
| 8,286,944 | B2 * | 10/2012 | Rossato et al. | 254/122 |
| 2004/0000664 | A1 | 1/2004 | Watkins | |
| 2004/0069979 | A1 * | 4/2004 | Hicks et al. | 254/122 |
| 2006/0037518 | A1 | 2/2006 | Lopez Alba | |
| 2007/0017748 | A1 | 1/2007 | Heckert et al. | |
| 2012/0272584 | A1 * | 11/2012 | Bilsen et al. | 52/7 |

* cited by examiner

SCISSOR LIFT

CROSS-REFERENCE TO RELATED APPLICATIONS

This application claims the benefit under 35 USC §119(e) from U.S. Application 61/467,947, filed Mar. 25, 2011, the contents of which are incorporated herein by reference.

FIELD OF THE INVENTION

The present invention relates to scissor lifts in general, and more particularly to, in one embodiment, a low profile scissor lift having curved legs with improved mechanical advantage.

BACKGROUND

Traditional scissor lifts are defined by a scissor assembly driven by a motor or the like that is placed on the ground or the base of the lift. The motor is typically connected to the scissor assembly by a piston and cylinder, whereby the motor activates the piston and cylinder against the scissor assembly to force the scissor assembly from a collapsed position into an extended position. This configuration traditionally requires a large amount of power or force, or an oversized motor, to initiate movement of the scissor assembly because of the poor mechanical advantage of a scissor assembly when started from a completely collapsed condition. Thus, the power required to operate a scissor lift from a fully collapsed condition to a fully extended condition is inconsistent, with more power needed at the beginning and less power needed toward the end of the extension. Moreover, because of the large power requirements at the beginning, the motor tends to be oversized and bulky. In addition, traditional scissor lifts tend to have an extended profile due to the configuration of the scissor arm assemblies, which results in an unnecessary allocation of vertical space.

SUMMARY

The scissor lift of one embodiment of the present invention comprises a load support, a lift support, and a plurality of scissor assemblies attached between the load support and the lift support. The scissor assemblies are driven into an open or a closed position by a drive device that enables movement of the load support relative to the lift support with the opening and closing of the scissor assemblies. Each scissor assembly is further defined by a pair of arms attached at a pivot. Each arm is further defined by an inside section and a curved, outside section, wherein a linear relationship is defined between the curvature of the curved, outside section and a relative movement experienced between the load support and the lift support during the opening or closing of the scissor assemblies. In another embodiment, a single scissor assembly is provided with curved arm surfaces that function in a similar manner. The linear relationship defined by the curved sections of the scissor arms and the movement of the roller assemblies and the movement of the load support results in a consistent power requirement at the drive device with improved mechanical advantage and a compact profile. Such a compact profile benefits from the use of a smaller drive device positioned between the scissor arms or the scissor assemblies, rather than a large and bulky drive device that must be supported on the ground or the base of the lift support.

DETAILED DESCRIPTION OF THE PREFERRED EMBODIMENTS

Figure 1:
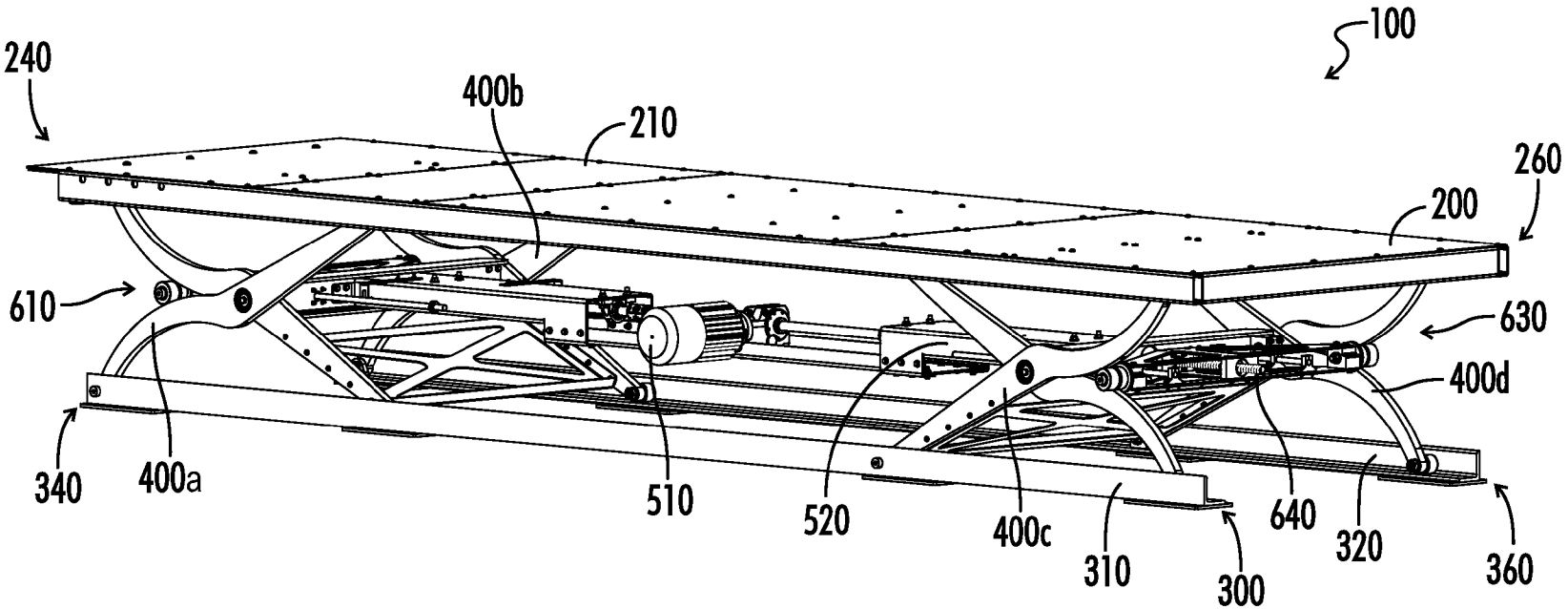
FIG. 1 is a perspective view of one embodiment of a scissor lift in an open orientation.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
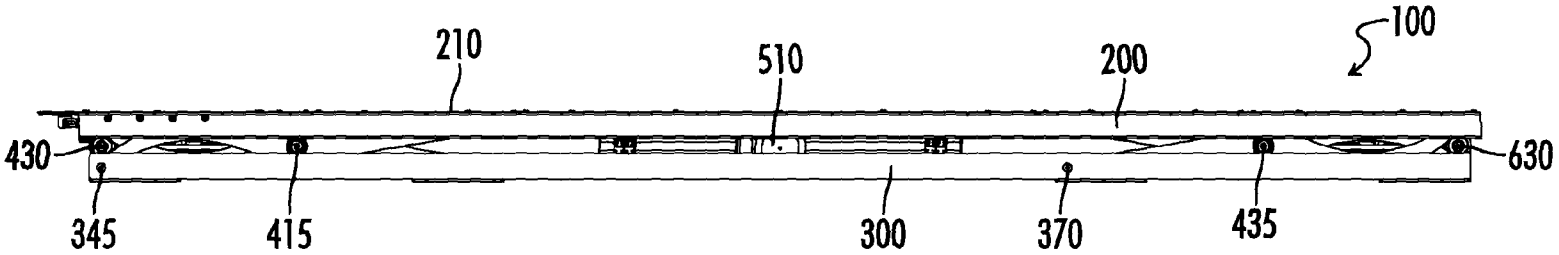
FIG. 2 is a perspective view of one embodiment of a scissor lift in a collapsed orientation.

FIG. 1 is a perspective view of one embodiment of a scissor lift 100, generally comprising a load support 200, a lift support 300, and a plurality of scissor assemblies 400*a*, 400*b*, 400*c*, and 400*d* (collectively referred to as scissor assemblies 400) attached between the load support 200 and the lift support 300. The scissor assemblies 400 enable movement of the load support 200 relative to the lift support 300 between an extended position shown in FIG. 1 and a collapsed position shown in FIG. 2, with the opening and closing of the scissor assemblies 400. The load support 200 is typically provided with a solid top 210 that is intended to transport a load (not shown) such as a vehicle, for example, that might be lifted between a first elevation (FIG. 2) to a second elevation (FIG. 1). For example, the scissor lift 100 might be used as an elevator to transport a vehicle between various levels in a parking garage (not shown). While a solid, rectangular top 210 is shown, it will be appreciated that the top may not be solid or rectangular, and may be any shape or construction desired as long as the load support 200 is able to support a load for which it is intended. Other load support constructions are possible. The lift support 300 is typically supported on or anchored to a planar surface such as the ground or a foundation, and may further comprise a pair of lift support rails 310 and 320 as shown. The lift support 300 may also be constructed in the form of a platform (not shown) similar to the top 210 of the load support 200. Other lift support constructions are possible.

FIG. 1 illustrates scissor assemblies 400*a* and 400*b* located on one end 240, 340 of the load and lift supports 200, 300 respectively, and scissor assemblies 400*c* and 400*d* located on the other end 260, 360 of the load and lift supports 200, 300 respectively. While four scissor assemblies 400*a*-400*d* are illustrated, it will be appreciated that only one or at least one scissor assembly may be used as described below in connection with the embodiment of FIGS. 6-15, or that only one scissor assembly may be located on one end 240, 340 of the load and lift supports 200, 300 respectively, and one scissor assembly may be located on the other end 260, 360 of the load and lift supports 200, 300 respectively. For purposes of convenience in the embodiment of FIG. 1 through FIG. 5, and with reference to the front view of FIG. 3, there will be described one scissor assembly 410 located on one end 240, 340 of the load and lift supports 200, 300 respectively, and one scissor assembly 430 located on the other end 260, 360 of the load and lift supports 200, 300 respectively.

Figure 3:
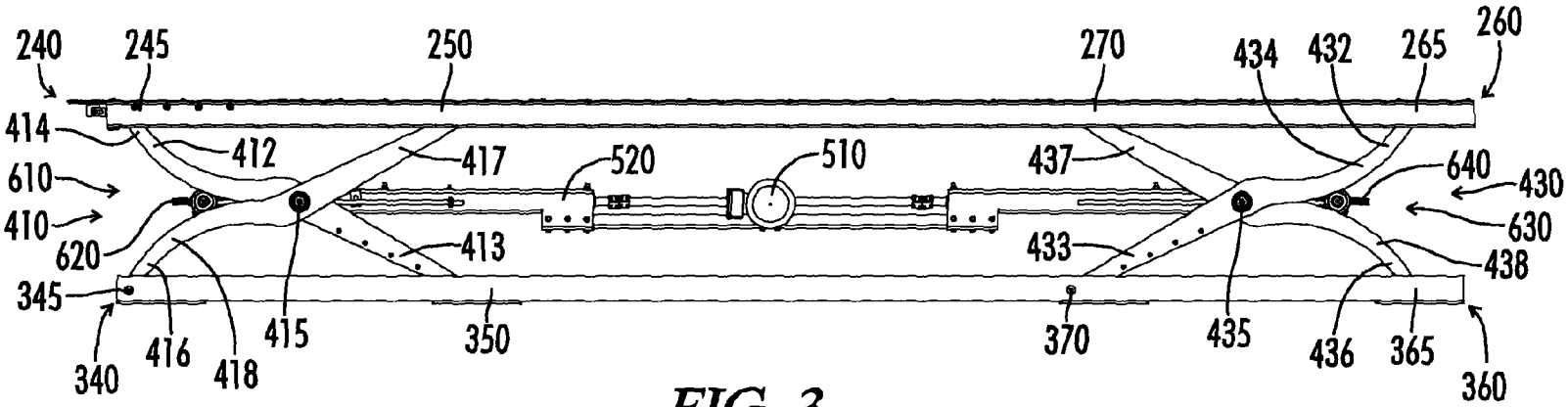
FIG. 3 is a side view of one embodiment of a scissor lift.

As illustrated in the embodiment of FIG. 3, scissor assembly 410 is further defined by a pair of arms 412, 416, attached at a pivot 415, each arm further defined by an inside section 413, 417, and a curved, outside section 414, 418. Similarly, scissor assembly 430 is further defined by a pair of arms 432, 436, attached at a pivot 435, each arm further defined by an inside section 433, 437, and a curved, outside section 434, 438. The inside sections 413, 417 and 433, 437 of the scissor assemblies 410, 430 face each other, while the outside sections 414, 418 and 434, 438 face away from each other. The inside sections are preferably linear or straight, although they could have other configurations. The outside sections are preferably curved as will be described below. Each arm of each scissor assembly is connected to both the load support 200 and the lift support 300 such that the opening and closing of the scissor assemblies (as will be described below) results in a vertical movement of the load support 200 relative to the lift support 300. This is achieved by fixing certain arm sections relative to each of the load and lift supports and allowing certain arm sections to move, slide, or otherwise translate relative to such supports.

Figure 4:
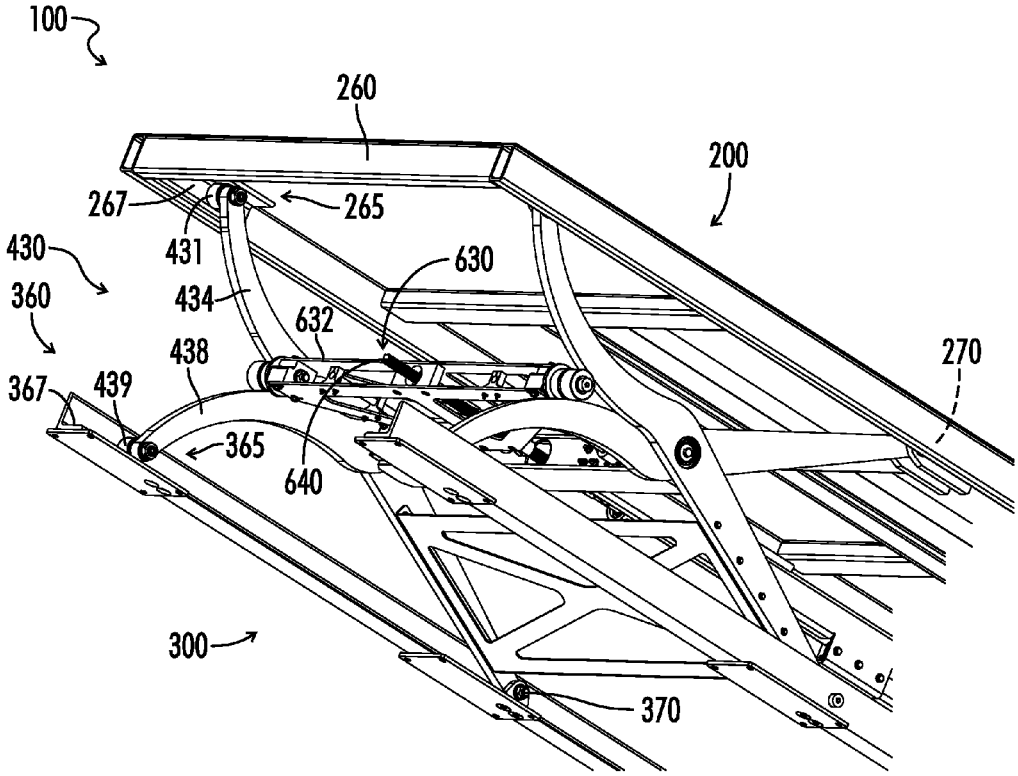
FIG. 4 is an underside view of one end of one embodiment of a scissor lift.

More specifically, in the embodiment of FIG. 3, outside sections 414 and 418 of scissor assembly 410 are fixed to the load support 200 and lift support 300 respectively through rotatable connections 245 and 345 respectively that allow the outside sections 414 and 418 to rotate in place relative to the load and lift supports. Inside sections 437 and 433 of scissor assembly 430 are similarly fixed to the load support 200 and lift support 300 respectively through similar connections 270 and 370 (see also FIG. 4) respectively. On the other hand, inside sections 417 and 413 of scissor assembly 410 are connected to the load support 200 and lift support 300 respectively through movable connections 250 and 350 respectively, while outside sections 434 and 438 of scissor assembly 430 are connected to the load support 200 and lift support 300 respectively, through movable connections 265 and 365 respectively. As shown in the embodiment of FIG. 4, one type of movable connection 265 and 365 includes a roller 431 and 439 mounted on the end of the outside sections 434 and 438, respectively, that roll along sections 267 and 367 in the load and lift supports 200 and 300, respectively as the scissor assemblies move between an open and closed position. Other types of movable connections are possible, including, but not limited to, a pin and slot type connection. While FIG. 3 illustrates a certain combination of fixed and movable connections, it will be appreciated that other configurations are possible as long as the same result is achieved, namely the movement of the load support 200 in a vertical plane relative to the lift support 300.

The scissor assemblies of the embodiment of FIG. 1 through FIG. 5 are opened or extended through the use of a drive assembly 500 as shown in FIGS. 1 and 3, for example, which controls the opening and closing of the scissor assemblies that enable movement of the load support 200 relative to the lift support 300. The drive assembly 500 of the illustrated embodiment includes a drive device 510, such as a motor, supported by a drive assembly platform 520 that is fixed to and supported by the pivots 415 and 435, which are preferably pivot shafts connecting the scissor assemblies. By aligning the drive assembly platform 520 with the pivots 415 and 435, the drive assembly 500 is maintained in a constant orientation relative to a defined plane between the load and lift supports 200 and 300. The drive device 510 drives a first roller assembly 610 associated with the first scissor assembly 410 and a second roller assembly 630 associated with the second scissor assembly 430, the drive device 510 driving the first and second roller assemblies 610, 630 via first and second drive shafts 620, 640 respectively. In the illustrated embodiment, the drive shafts 620, 640 are screw shafts that rotate in opposite directions relative to the drive device 510 when driven thereby.

Figure 5:
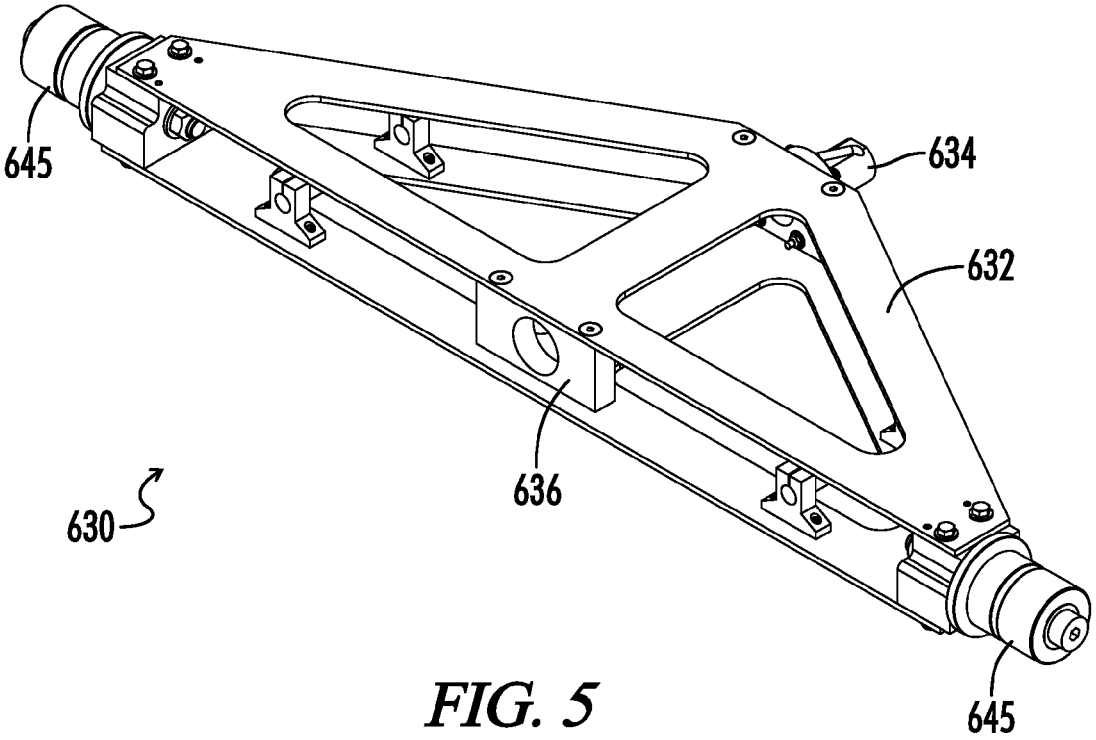
FIG. 5 illustrates a roller assembly.
Figure 6:
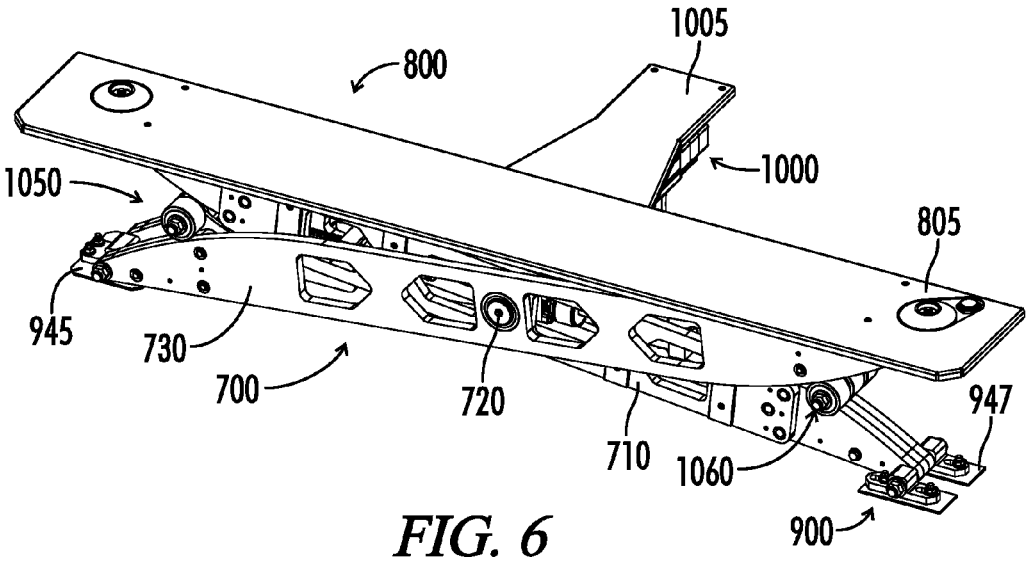
FIG. 6 is an upper frontal isometric view of an alternative embodiment of a scissor lift assembly in an open or extended orientation.

As shown in the embodiment of FIG. 4 and FIG. 5, roller assembly 630 further comprises a bracket 632 including a threaded nut 634 and guide 636 that receives drive shaft 640 therethrough. The roller assembly 630 further comprises a pair of rollers 645 on opposite ends of the bracket 632 that contact the outside sections of the scissor assemblies. When the drive device 510 drives the drive shafts 620, 640 in one direction, both roller assemblies 610, 630 are drawn toward the drive 510 through the engagement of the screw shafts with the threaded nuts on the roller assembly brackets, which forces the rollers 645 against the outside sections of the scissor assemblies, which causes the arms of the scissor assemblies to separate relative to the pivots, which causes the load support 200 to move away from or elevate relative to the lift support 300. Similarly, when the drive device 510 drives the drive shafts 620, 640 in the opposite direction, both roller assemblies 610, 630 are forced away from the drive 510, which causes the rollers 645 to travel down the outside sections of the scissor assemblies, which causes the arms of the scissor assemblies to close relative to the pivots, which causes the load support 200 to move toward or collapse relative to the lift support 300. The movement of the scissor arms is facilitated in the illustrated embodiment by the movement of the rollers 431, 439 (see FIG. 4) along the tracks 267, 367 respectively, and the rotation of the fixed ends of the scissor arms relative to the load and lift supports.

The curved configuration of the outside sections of the scissor arm assemblies results in a linear relationship between the movement of the load support 200 relative to the lift support 300 and the movement of the roller assemblies 610, 630 along the curved, outside sections of the scissor assemblies. More specifically, movement of the roller assemblies along a unit distance results in the load support moving relative to the lift support through a distance that is a consistent multiple of the unit distance, where such multiple can be a fraction or an integer. In one example, for every inch that the rollers move along the scissor arms, the load support would move one and one-half inches. This result is achieved with a curved outside section having a radius of curvature of approximately twenty-five inches. Other dimensional variations are possible.

The use of curved outside sections also minimizes the power required by the drive device to initiate movement in the load support because the movement of the rollers is consistent along the entirety of the curved outside sections regardless of the height of the load platform relative to the lift platform. Thus, a drive device with a consistent power requirement and improved mechanical advantage is a benefit and feature of the present invention.

In addition, the construction of the scissor assemblies and their connection to the load and lift supports, in combination with the unique drive assembly, results in a compact profile that is more versatile and is capable of being used in a variety of environments. Such a compact profile benefits from the use of a smaller drive device positioned between the scissor assemblies, rather than a large and bulky drive device that must be supported on the ground or the base of the lift support. For example, where excessive room might have been necessary for a rack and pinion type of lift, one is able to use the scissor lift of the embodiments described above with reduced space requirements and a compact storage profile. In one embodiment, a scissor lift constructed in accordance with an embodiment described herein has a fully collapsed or compacted height of ten inches, with a vertical travel of two feet, which results in an overall height from the base of the lift support to the top of the load support of almost three feet. Other dimensional achieves are possible.

FIGS. 6-15 illustrate an alternative embodiment of a scissor assembly 700 that would be attached between a load support 800 and a lift support 900 for enabling movement of the load support 800 relative to the lift support 900 between an extended position shown in FIGS. 5, 6, and 12-15 and a collapsed position shown in FIGS. 8-11, with the opening and closing of the scissor assembly 700 driven by a drive assembly 1000. The load support 800 is typically provided with a solid top that is intended to transport a load (not shown) such as a vehicle, for example, although other than a solid top may be used. In certain embodiments, the load support 800 is shown with a cover member 805, while in other embodiments and figures the cover member 805 is not shown to better illustrate elements of the scissor assembly 700. Similarly, in certain embodiments, the drive assembly 1000 is shown with a cover member 1005, while in other embodiments and figures the cover member 1005 is not shown to better illustrate elements of the drive assembly 1000. The lift support 900 is typically supported on or anchored to a planar surface such as the ground or a foundation and can assume a variety of constructions as described previously in connection with the previous embodiment. While the previous embodiment of FIGS. 1-5 described a plurality of scissor assemblies between a load support and a lift support, the embodiment of FIGS. 6-15 illustrates only a single scissor assembly 700. However, it is understood that while at least one scissor assembly is preferred, more than one scissor assembly may be used.

Figure 12:
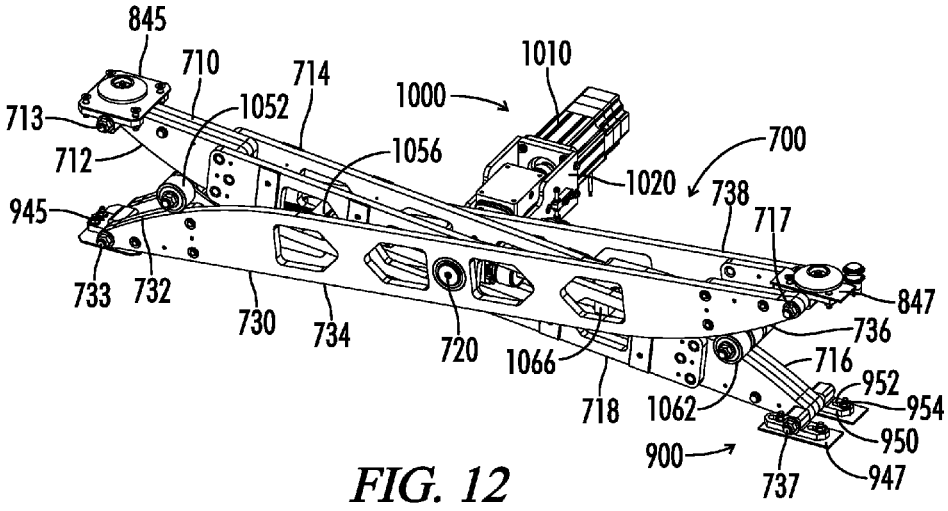
FIG. 12 is an isometric view of one embodiment of a scissor assembly in an open position.
Figure 13:
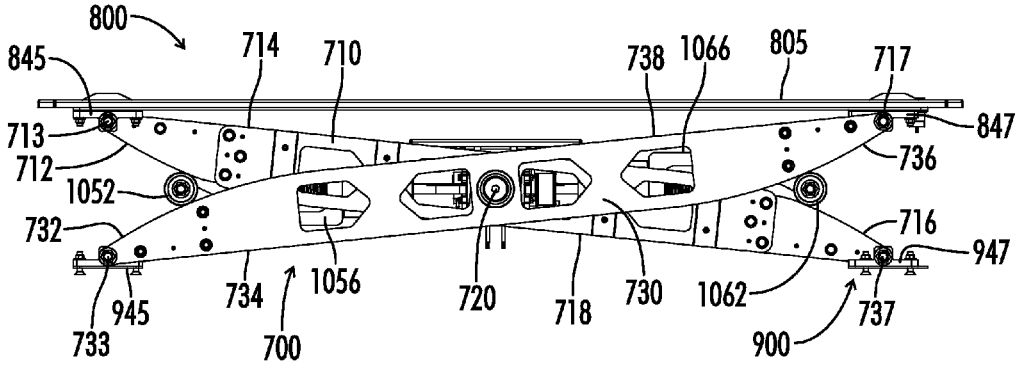
FIG. 13 is a front view of one embodiment of a scissor assembly in an open position.
Figure 14:
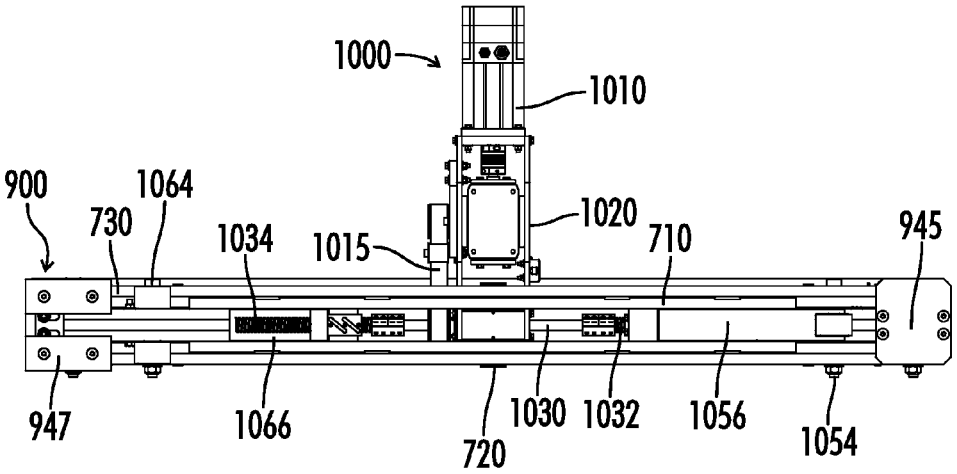
FIG. 14 is a bottom view of one embodiment of a scissor assembly in an open position.
Figure 15:
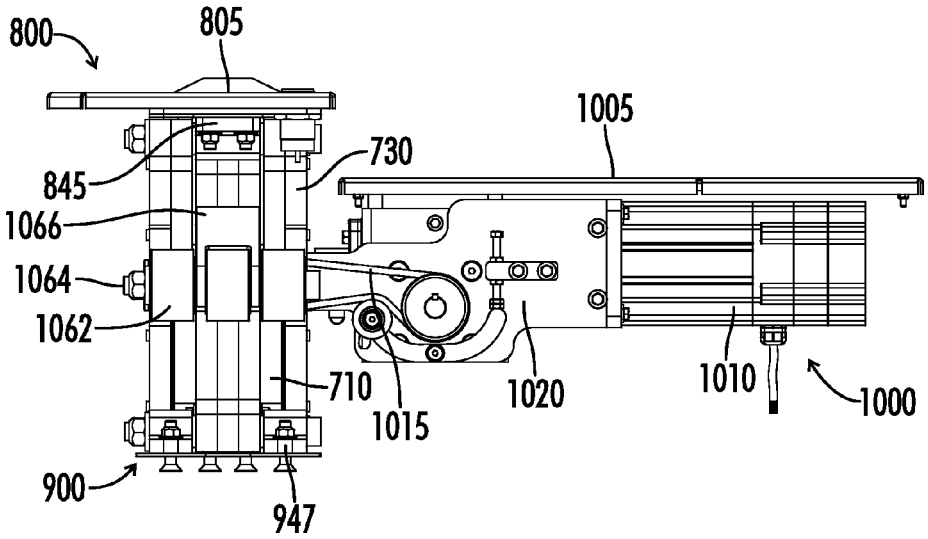
FIG. 15 is a side view of one embodiment of a scissor assembly in an open position.

Scissor assembly 700 is further defined by a pair of arms 710, 730, attached at a pivot 720, each arm further defined by a plurality of curved surfaces 712, 716 on arm 710 and 732, 736 on arm 730, and a plurality of preferably non-curved surfaces 714, 718 on arm 710 and 734, 738 on arm 730 as shown in FIGS. 12-13. The non-curved surfaces are preferably linear or straight, although they could have other configurations. Each arm 710, 730 of the scissor assembly 700 is connected to both the load support 800 and the lift support 900 such that the opening and closing of the scissor assembly (as will be described below) results in a vertical movement of the load support 800 relative to the lift support 900. This is achieved by fixing certain arm sections relative to each of the load and lift supports and allowing certain arm sections to move, slide, or otherwise translate relative to such supports.

Figure 7:
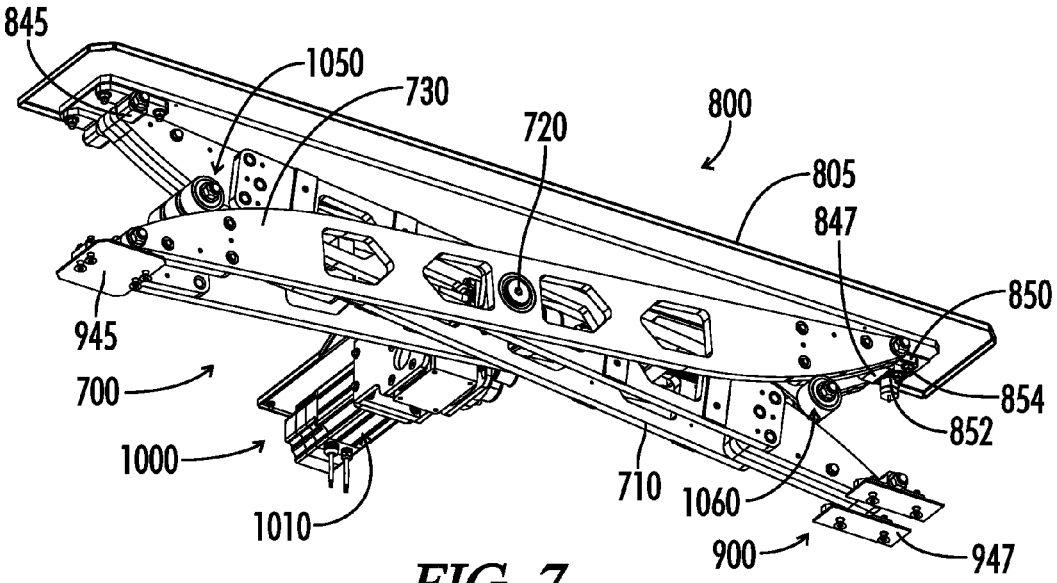
FIG. 7 is a bottom isometric view of the assembly of FIG. 6.
Figure 8:
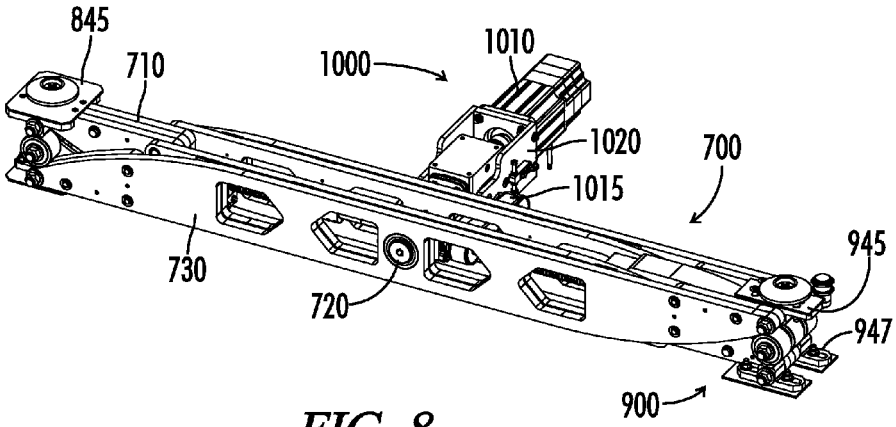
FIG. 8 is an isometric view of one embodiment of a scissor assembly in a collapsed position.

More specifically as illustrated in the embodiment of FIGS. 12-13, first ends 713, 733 of scissor arms 710, 730 are attached to the load support 800 and lift support 900 respectively through a pair of fixed, rotatable connections 845 and 945 respectively that allow the first ends 713, 733 to rotate in place within the rotatable connections 845, 945 relative to the load and lift supports. On the other side of the scissor assembly 700, second ends 717, 737 of scissor arms 710, 730 are attached to the load support 800 and lift support 900 respectively through a pair of movable, rotatable connections 847 and 947 respectively that allow the second ends 717, 737 to both rotate in place within the rotatable connections 847, 947 and move relative to the load and lift supports. As shown in the embodiment of FIGS. 7 and 12, one type of movable connection 847, 947 includes a bracket 850, 950 having slots 852, 952 for the extension of pins or fasteners 854, 954 extending from the load support 800 and lift support 900 respectively. While the pins or fasteners are 854, 954 are fixed to the load support 800 and lift support 900 respectively, the slotted brackets 850, 950 are capable of translating relative to the fasteners 854, 954 during the opening and closing of the scissor assembly 700. Other types of movable connections are possible, including, but not limited to, roller connections as previously described and other connections. While the embodiments of FIGS. 6-15 illustrate a certain combination of fixed and movable connections, it will be appreciated that the fixed and movable connections can be reversed, and other configurations are possible as long as the same result is achieved, namely the movement of the load support 800 relative to the lift support 900.

The scissor assembly 700 of the embodiment of FIG. 6 through FIG. 15 is opened or extended through the use of a drive assembly 1000 that includes a drive device 1010, such as a motor, supported by a drive assembly platform 1020 that is attached to a central shaft 1030 by bearings on either side of the pivot 720, which maintains the drive assembly 1000 in a constant orientation relative to a defined plane between the load and lift supports 800 and 900. The drive assembly 1000 further comprises a belt drive 1015 driven by the drive device 1010 that engages the central shaft 1030 that is threadedly engaged with a first roller assembly 1050 associated with the curved surfaces 712, 732 on the scissor arms 710, 730, and a second roller assembly 1060 associated with the other curved surfaces 716, 736. The first and second roller assemblies 1050, 1060 (FIGS. 6-7) respectively further comprise a plurality of rollers 1052, 1062 (FIG. 13) attached to an axle 1054, 1064 (FIG. 14) that is connected to the central shaft 1030 by a plurality of yokes 1056, 1066 (FIG. 14) that are each axially translated, through the rotation of the central shaft 1030, toward or away from the pivot 720. In the illustrated embodiment, the central shaft 1030 is attached to a threaded shaft 1032 on one side of the pivot 720 and an oppositely threaded shaft 1034 on the other side of the pivot 720, each threaded shaft 1032, 1034 engaging its respective yoke 1056, 1066 such that the yokes 1056, 1066 are simultaneously drawn toward or moved away from the central pivot 720 region.

Figure 9:
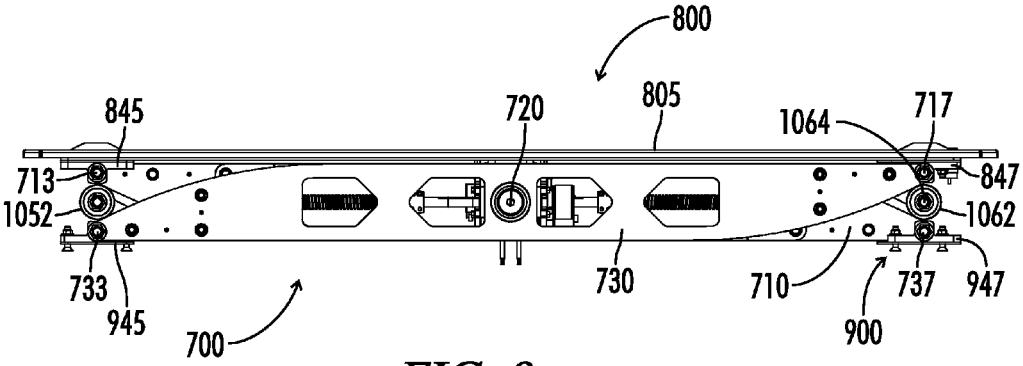
FIG. 9 is a front view of one embodiment of a scissor assembly in a collapsed position.
Figure 10:
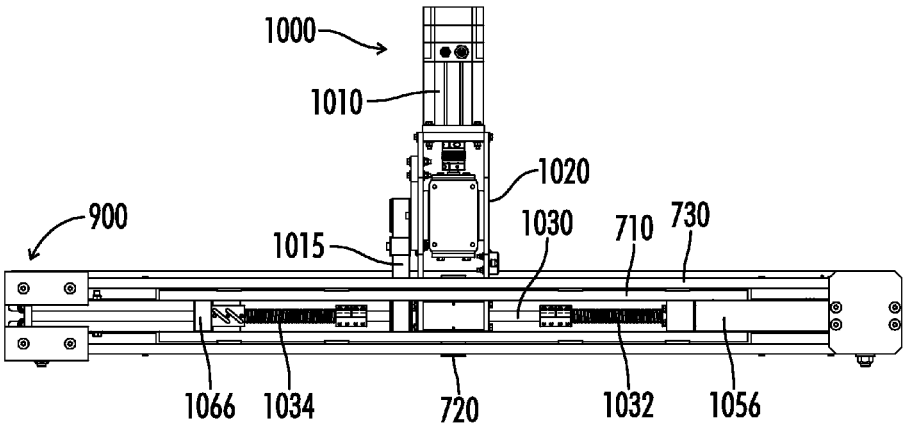
FIG. 10 is a bottom view of one embodiment of a scissor assembly in a collapsed position.
Figure 11:
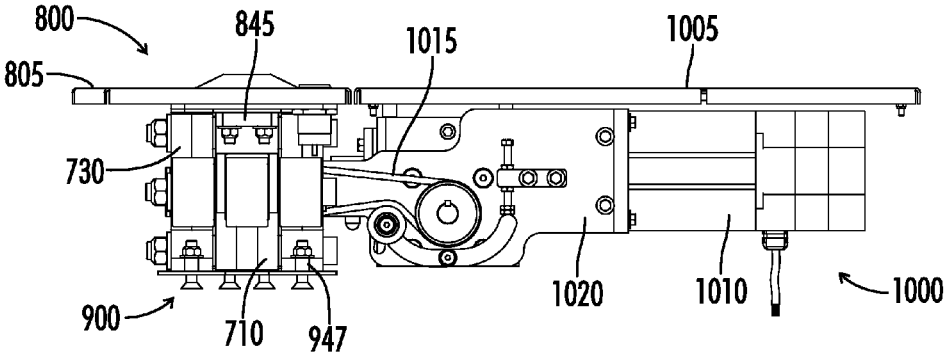
FIG. 11 is a side view of one embodiment of a scissor assembly in a collapsed position.

FIGS. 8-11 illustrate an embodiment of the scissor assembly 700 in the closed position with the load support 800 lowered relative to the lift support 900 and with the rollers 1052, 1062 fully extended relative to the central pivot 720 such that the roller axles 1054, 1064 are substantially aligned with the first ends 713, 733 and second ends 717, 737 of the scissor arms 710, 730 respectively (FIG. 9). When it is desired to raise the load support 800 relative to the lift support 900, the drive device 1010 engages the central shaft 1030 via the belt drive 1015 to cause the threaded shafts 1032, 1034 to engage the yokes 1056, 1066 and draw them toward the pivot 720, which urges the rollers 1052 and 1062 against the curved surfaces 712, 732 and 716, 736 respectively, which causes the arms 710, 730 of the scissor assembly to separate relative to the pivot 720, which causes the load support 800 to move away from or elevate relative to the lift support 900. Similarly, when the drive device 1010 drives the drive shaft 1030 in the opposite direction, both roller assemblies 1050, 1060 are forced away from the pivot 720, which causes the rollers 1052, 1062 to travel down the curved surfaces 712, 732 and 716, 736 of the scissor arms 710, 730, which causes the arms of the scissor assemblies to close relative to the pivot 720, which causes the load support 800 to move toward or collapse relative to the lift support 900. The movement of the scissor arms 710, 730 is further facilitated by the movement of the movable, rotatable connections 847 and 947 relative to the load and lift supports, and more specifically, in the currently described embodiment by the lateral movement of the second ends 717, 737 relative to the first ends 713, 733 during the rotation of the scissor arms 710, 730 around the pivot 720.

The curved surfaces 712, 732 and 716, 736 of the scissor arm assembly 700 results in a linear relationship between the movement of the load support 800 relative to the lift support 900 and the movement of the roller assemblies 1050, 1060 along the curved surfaces. More specifically, movement of the roller assemblies along a unit distance results in the load support moving relative to the lift support through a distance that is a consistent multiple of the unit distance, where such multiple can be a fraction or an integer. In one example, for every inch that the rollers move along the scissor arms, the load support would move one and one-half inches. This result is achieved with a curved outer surface having a radius of curvature of approximately twenty-five inches. Other dimensional variations are possible.

For all of the previously-described embodiments, the use of curved outside sections or surfaces also minimizes the power required by the drive device to initiate movement in the load support because the movement of the rollers is consistent along the entirety of the curved outside sections or surfaces regardless of the height of the load support relative to the lift support. Thus, a drive device with a consistent power requirement and improved mechanical advantage is a benefit and feature of the present invention.

Similar to the earlier-described embodiment, the construction of the scissor assembly and its connection to the load and lift supports, in combination with a unique drive assembly that is supported by the central shaft and situated between the load and lift supports, also results in a compact profile that is more versatile and is capable of being used in a variety of environments. Such a compact profile benefits from the use of a smaller drive device positioned along the pivot plane, rather than a large and bulky drive device that must be supported on the ground or the base of the lift support.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A scissor lift comprising:

a) a load support, a lift support and a plurality of scissor assemblies attached between the load support and the lift support that enable movement of the load support relative to the lift support with the opening and closing of the scissor assemblies;

b) the plurality of scissor assemblies including a first scissor assembly attached between one end of the load and lift supports, and a second scissor assembly attached between the other end of the load and lift supports;

c) each scissor assembly further defined by a pair of arms attached at a pivot, each arm further defined by an inside section and a curved, outside section, the curved, outside sections of the first and second scissor assemblies facing away from each other;

d) wherein the curved, outside sections of the first scissor assembly are rotatably fixed relative to the load and lift supports, and wherein the curved, outside sections of the second scissor assembly are movable relative to the load and lift supports.

2. The scissor lift of claim 1, wherein the curved, outside sections of the second scissor assembly further comprise rollers for enabling rolling movable relative to the load and lift supports.

3. The scissor lift of claim 1, further comprising a drive assembly that controls the opening and closing of the scissor assemblies for enabling movement of the load support relative to the lift support.

4. The scissor lift of claim 3, the drive assembly further comprising a drive device that drives a first roller assembly associated with the first scissor assembly and a second roller assembly associated with the second scissor assembly, the drive device driving the first and second roller assemblies via first and second drive shafts respectively.

5. The scissor lift of claim 4, wherein the roller assemblies are driven toward or away from the drive device along a plane defined through the pivots.

6. The scissor lift of claim 5, wherein the roller assemblies move along the curved, outside sections of the scissor assemblies and cause the scissor assemblies to open or close.

7. The scissor lift of claim 6, wherein there is a linear relationship between the movement of the roller assemblies along the curved, outside sections of the scissor assemblies and movement of the load support relative to the lift support.

8. The scissor lift of claim 7, wherein movement of the roller assemblies along a unit distance results in the load support moving relative to the lift support through a distance that is a multiple of the unit distance.

9. The scissor lift of claim 8, wherein the multiple is 1.5.

10. The scissor lift of claim 3, wherein the drive assembly is supported by a drive platform that is fixed along a plane between the pivots of the first and second scissor assemblies.

11. The scissor lift of claim 10, wherein the drive assembly further comprises a drive device that is supported by the drive platform.

12. The scissor lift of claim 1, wherein the inside sections are linear.

13. The scissor lift of claim 1, wherein the outside sections of the first scissor assembly are rotatably fixed to the load and lift supports, and wherein the outside sections of the second scissor assembly are movable through a roller connection to the load and lift supports.

14. A scissor lift comprising:

a. a load support, a lift support and a plurality of scissor assemblies attached between the load support and the lift support that enable movement of the load support relative to the lift support with the opening and closing of the scissor assemblies, and a drive assembly that controls the opening and closing of the scissor assemblies for enabling movement of the load support relative to the lift support, b. the plurality of scissor assemblies including a first scissor assembly attached between one end of the load and lift supports, and a second scissor assembly attached between the other end of the load and lift supports;

c. each scissor assembly further defined by a pair of arms attached at a pivot, each arm further defined by an inside section and a curved, outside section, the curved, outside sections of the first and second scissor assemblies facing away from each other.

15. The scissor lift of claim 14, the drive assembly further comprising a drive device that drives a first roller assembly associated with the first scissor assembly and a second roller assembly associated with the second scissor assembly, the drive device driving the first and second roller assemblies via first and second drive shafts respectively.

16. The scissor lift of claim 15, wherein the roller assemblies are driven toward or away from the drive device along a plane defined through the pivots.

17. The scissor lift of claim 16, wherein the roller assemblies move along the curved, outside sections of the scissor assemblies and cause the scissor assemblies to open or close.

18. The scissor lift of claim 17, wherein there is a linear relationship between the movement of the roller assemblies along the curved, outside sections of the scissor assemblies and movement of the load support relative to the lift support.

19. The scissor lift of claim 18, wherein movement of the roller assemblies along a unit distance results in the load support moving relative to the lift support through a distance that is a multiple of the unit distance.

20. The scissor lift of claim 19, wherein the multiple is 1.5.

21. The scissor lift of claim 14, wherein the drive assembly is supported by a drive platform that is fixed along a plane between the pivots of the first and second scissor assemblies.

22. The scissor lift of claim 21, wherein the drive assembly further comprises a drive device that is supported by the drive platform.

* * * * *